US006208313B1

(12) United States Patent
Frank et al.

(10) Patent No.: US 6,208,313 B1
(45) **Date of Patent: *Mar. 27, 2001**

(54) SECTORAL ANTENNA WITH CHANGEABLE SECTOR BEAMWIDTH CAPABILITY

(75) Inventors: Peter Michael Frank; Donald E. Sawchuk, both of Winnipeg (CA)

(73) Assignee: Nortel Networks Limited, Montreal (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,010

(22) Filed: Feb. 25, 1999

(51) Int. Cl.[7] ..... H01Q 13/02
(52) U.S. Cl. ..... 343/853; 343/776
(58) Field of Search ..... 343/853, 700 MS, 343/762, 772, 786, 776, 778; 342/174

(56) References Cited

U.S. PATENT DOCUMENTS 5,412,414 * 5/1995 Ast et al. ..... 342/174
5,926,147 * 7/1999 Sehm et al. ..... 343/776
6,002,370 * 8/1998 Mckinnon et al. ..... 343/700 MS
6,031,491 * 9/1998 Daniel et al. ..... 343/700 MS

* cited by examiner

*Primary Examiner*—Don Wong
*Assistant Examiner*—James Clinger
(74) *Attorney, Agent, or Firm*—Dennis R. Haszko

(57) ABSTRACT

A modular antenna has a primary radiating aperture which can either be an array of radiating elements or a passive reflector. In regards to the array of radiating elements, a feed network interfaces with the radiating elements to form the modular antenna array. The feed network has a number of output ports wherein each output port of the feed network is adapted to interface with each feed port of the radiating elements. The feed network can be placed at various locations along the antenna array to change to radiation characteristics of the antenna array. When passive reflector is used, a modular feed interfaces with the waveguide. The feed module controls the sector radiation pattern. The vertical reflector surface controls the elevation radiation pattern. The feed module can consist either of an antenna array or a single element utilizing beam shaping.

10 Claims, 9 Drawing Sheets

SECTORAL ANTENNA WITH CHANGEABLE SECTOR BEAMWIDTH CAPABILITY

FIELD OF THE INVENTION

This invention relates to sector antennas, but more particularly to a sector antenna which can make use of various beam forming modules wherein the physical antenna aperture remains the same, while the beam forming module can vary to give the required beam width.

BACKGROUND OF THE INVENTION

Wireless transmission systems that make use of basestation antennas are configured according to the customer and network requirements. In particular, fixed broadband wireless networks which operate within a range of frequencies on different frequency bands can make use of several different types of antennas to enable the transmission and reception of the radio signals between various sites. Although a fixed wireless system may operate on as few as three different frequency bands, a system which may need to operate on a few different polarization scheme may require as many as 60 different antennas.

The problem associated with previous antenna designs is that if a different radiation pattern is required, a new antenna would have to be selected to provide this radiation pattern. Since multiple radiation patterns may be required in a multiband wireless network, several different types of antennas will be required thereby increasing the infrastructure cost of the network. In addition, once the antenna is installed in the field, there is very little flexibility which permit the modification of the radiation pattern without having to change the entire antenna.

For example, within each frequency band an antenna operating within say, a 90, 60, 45, 30 and 15 degree sector may be required. Since the system may require horizontally and vertically polarized antennas, many different styles of antennas are required.

A need therefore exists for a modular antenna which can overcome the problems associated with the prior art antennas. In particular, a need exists for an antenna arrangement which can be modified to change the beamwidth capability of the antenna without having to change the physical antenna aperture portion of the antenna.

SUMMARY OF THE INVENTION

In accordance with one aspect of the present invention, there is provided a modular antenna comprising an antenna panel having a number of antenna radiating elements forming an array, each radiating element having a feed port. A feed network interfaces with the radiating elements to form the modular antenna array. The feed network has a number of output ports, each output port of the feed network being adapted to interface with each feed port of the radiating elements.

The advantages of using the modular antenna of the present invention is that one antenna can be used in many different applications offering different radiation patterns. For volume manufacturing, only one antenna is required to be manufactured. The modular array provides flexibility by enabling a new module to be interfaced with the array to change the radiation pattern without having to disassemble the radio. In another embodiment, an active module can be used to dynamically modify the radiation pattern of the array.

The use of the array of antenna elements of the present invention permits the shaping of the beam into many different types of radiation patterns by adjusting the amplitude weighting of the elements.

DESCRIPTION OF THE PREFERRED EMBODIMENT

Figure 1:
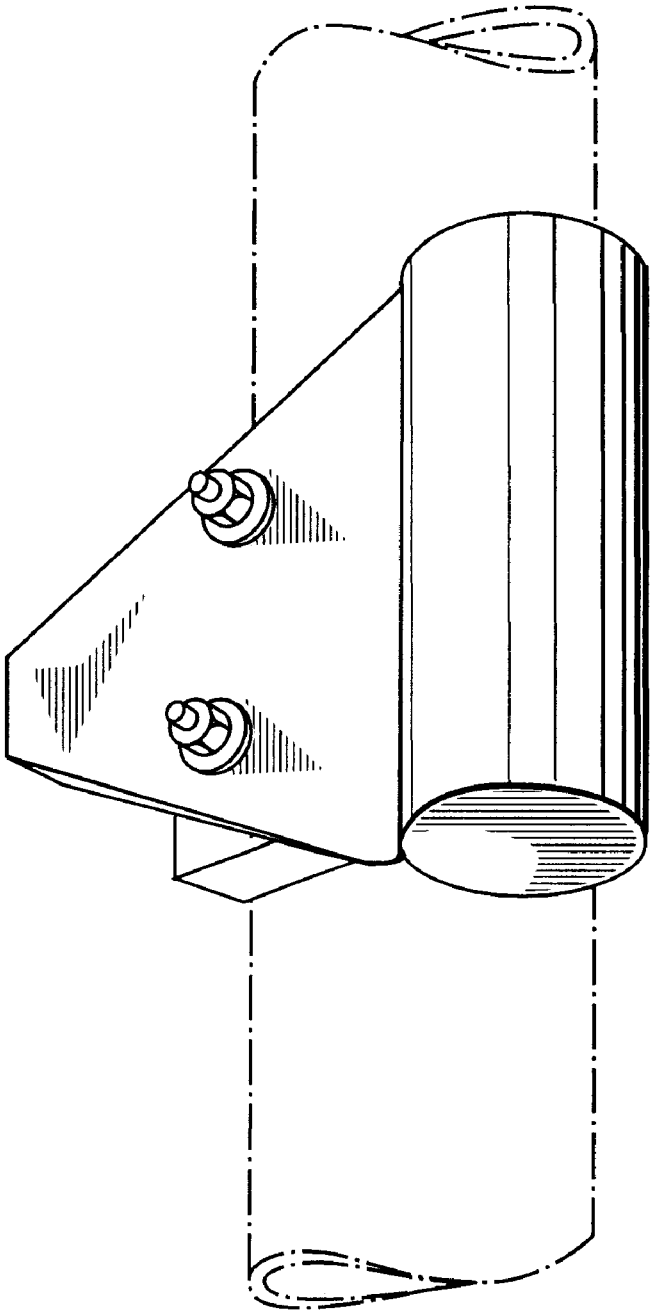
FIG. 1 PRIOR ART
FIG. 1 is an illustration of a polarized sectional antenna according to the prior art.

Referring now to FIG. 1, we have shown a diagram illustrating a polarized sectored antenna according to the prior art. This particular antenna design offers a 90° sector radiation pattern which is either vertically or horizontally polarized. If a different polarization pattern is required, a different type of antenna will be required.

Figure 2A:
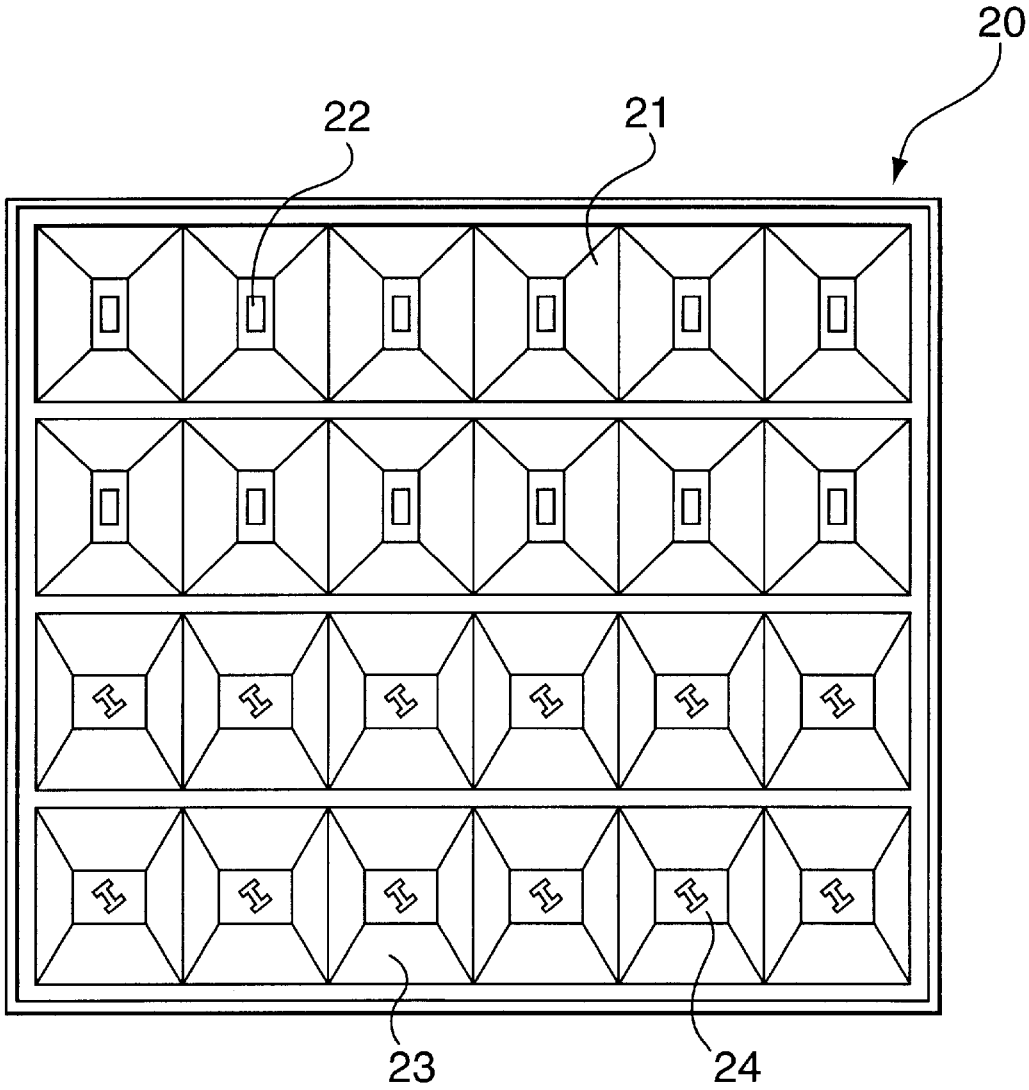
FIGS. 2*a*, 2*b* and 2*c* are front, cross-sectional top and back views respectively of an antenna panel according to a first embodiment of the present invention.
Figure 2B:
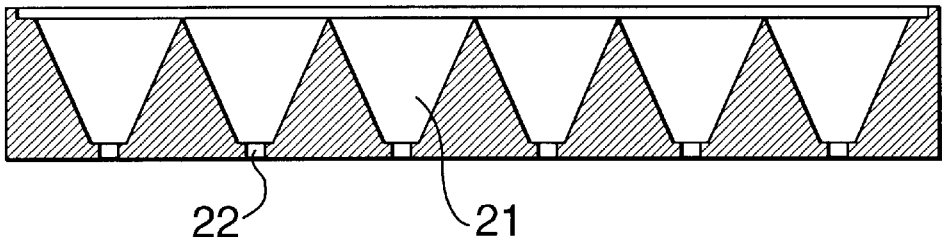

With reference to FIG. 2*a*, we have shown a front view of an antenna element panel according to the first embodiment of the present invention. The antenna element panel 20 comprises a plurality of antenna elements 21 laid out to radiate vertically and horizontally in a matrix to form the array. In the embodiment depicted in FIG. 2*a*, the first two rows of antenna elements provide horizontally polarized radiators. Each antenna element 21 includes a horizontal feed port 22 thereby polarizing the transmitted/received signal horizontally. The last two rows of antenna elements provide vertical polarization to the transmitted/received signal. The antenna elements 23 are each provided with a vertical feed port 24. A cross-sectional top view of the panel is illustrated in FIG. 2*b*. This top view shows the arrangement of antenna elements 21 having horizontal feed ports 22.

Although the radiating elements illustrated in FIGS. 2*a* and 2*b* are comprised of horn elements, the antenna array of the present invention can also make use of lens or printed radiating elements. Similarly, circularly polarized elements can also be used instead of linearly polarized elements.

Figure 2C:
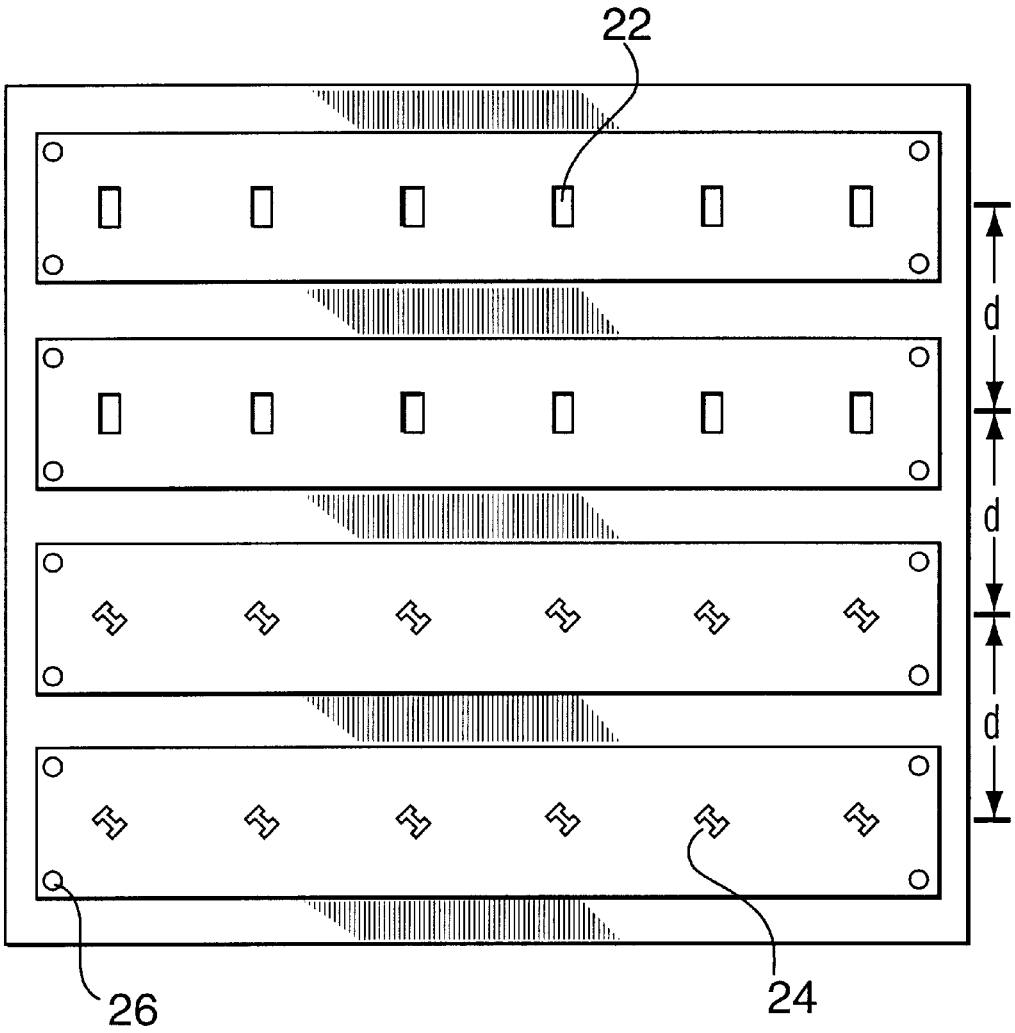

Referring now to FIG. 2*c*, we have shown a back view of the antenna element panel of FIG. 2*a*. One side of the antenna panel as illustrated in FIG. 2*a* consists of radiating elements and the other side of the panel as illustrated in FIG. 2*c* contains the feed ports of the radiating elements. As indicated above, the first two rows of radiating elements provide horizontal polarization and the last two rows of radiating elements provide vertical polarization. This is achieved using a horizontal feed port 22 for each of the radiating element of the first two rows and a vertical feed port 24 for each radiating element of the bottom two rows of the array. Each row of radiating elements is provided with a number of alignment dowel pins 26 to enable the alignment of feed network modules (not shown) when the modules are secured to the back of the antenna element panel.

Figure 3A:
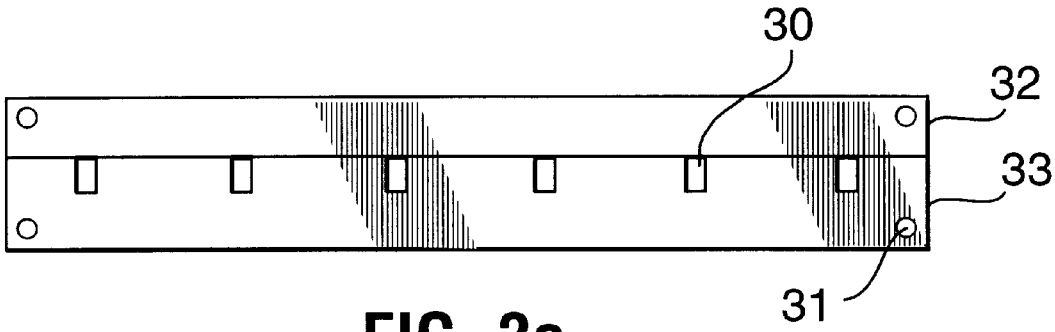
FIGS. 3*a*, 3*b* and 3*c* are front, top and back views respectively of the phase and power distribution module for use with the antenna panel of FIGS. 2*a*, 2*b* and 2*c;*
Figure 3B:
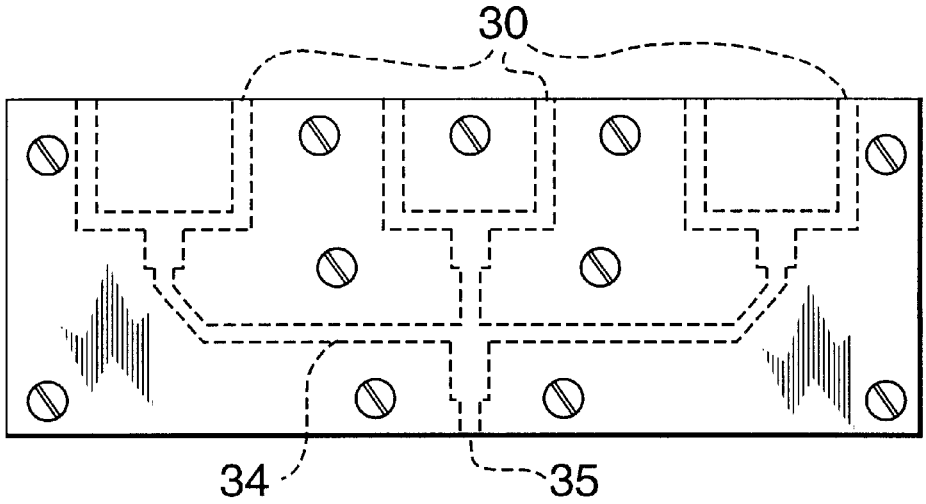
Figure 3C:
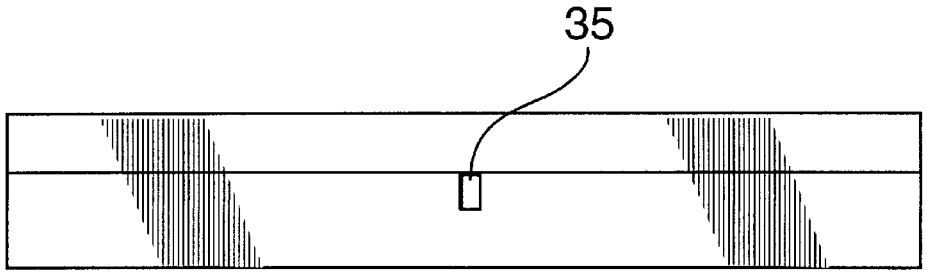

Referring now to FIGS. 3*a*, 3*b* and 3*c*, we have shown a front, top and back view respectively of the phase and power distribution module of the present invention. As indicated earlier, the power distribution module is used in conjunction with the antenna element panel of FIGS. 2*a*, 2*b* and 2*c*. Each module is provided with a series of output ports adapted to mate with the feed port of each antenna element. A corresponding number of dowel pin receptacles 31 are provided on the front of the module to enable easy and quick installation of the module on the back of the antenna panel. The module can thus be moved vertically along the back of the panel to provide the required radiation pattern. The module is assembled from two parts. A cover 32 and a base portion 33 into which is formed the power distribution network 34 shown in a dotted line in FIG. 3*b*. The power distribution network 34 enables a signal coming in at an input port 35 to be equally distributed among a number of output ports 30. This is achieved by means of one or more transmission lines which, in this embodiment, act as a waveguide. As will be shown further below, variations of the output signal can be achieved by changing the distribution pattern of the network. As indicated earlier, each output port is adapted to mate with a feed port of an antenna element to provide the required radiation pattern. The module, and in particular the power distribution network, can either be molded into the base portion 33 or designed as a printed structure on the surface of the base portion 33. The back view is shown in FIG. 3*c*.

Figure 4A:
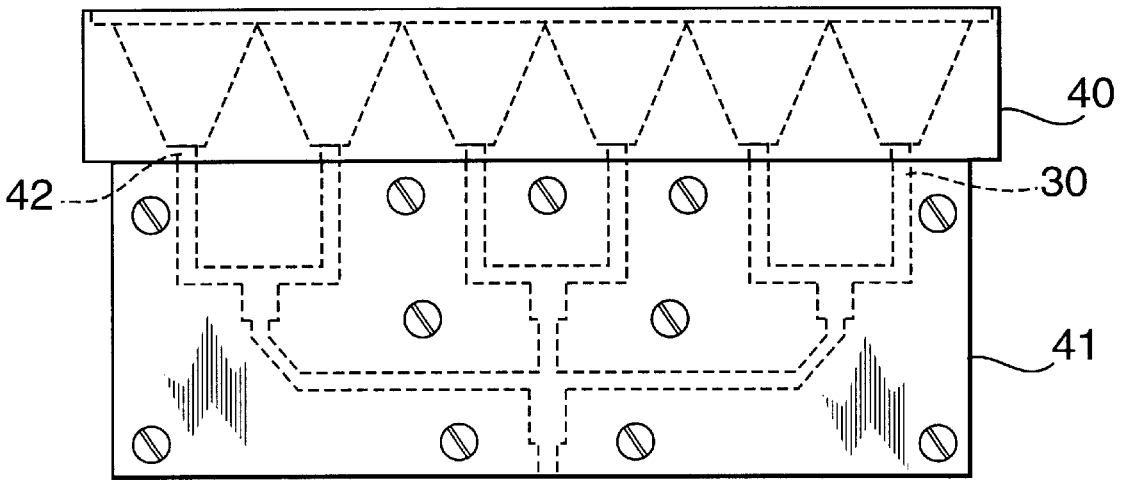
FIGS. 4*a* and 4*b* are top and side views of the combination antenna panel and power distribution module of the present invention.

In combination, the antenna panel and module are set up as illustrated in FIG. 4*a*, which is a top view of the panel/module combination. The antenna panel is illustrated at reference numeral 40 and the module at reference numeral 41. As indicated earlier, the panel 40 and module 41 are quickly aligned by means of dowel pins and receptacles. This enables the proper alignment of the module output ports 30 and the antenna panel feed ports 42 which depending on the alignment of the module along the panel can either be a horizontal feed port or a vertical feed port as shown in FIG. 2*c*.

Figure 4B:
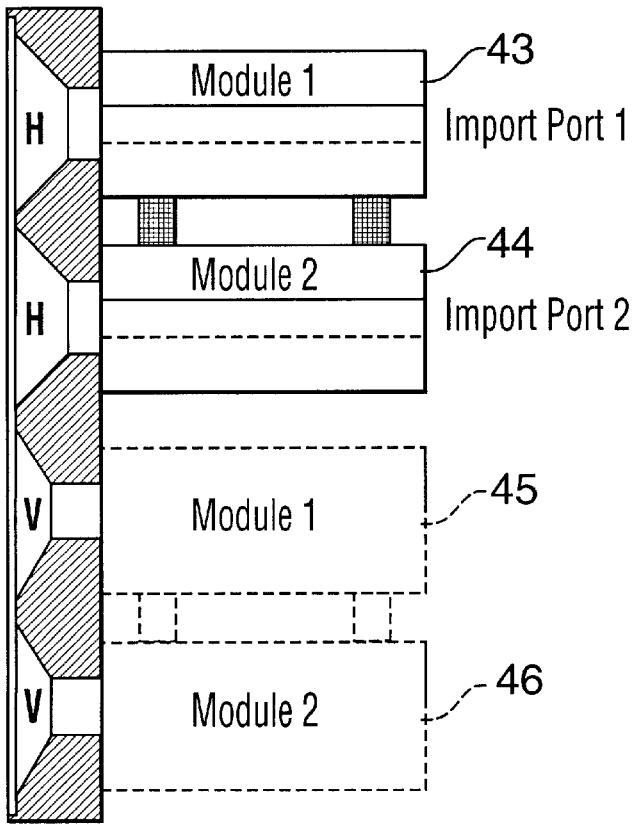

A side view of the panel module combination is illustrated in FIG. 4*b*. In this embodiment, a first and second module 43 and 44 respectively are disposed on the first two rows of radiating elements to provide a horizontal/horizontal module configuration. In this configuration, a horizontally/horizontally polarized radiation pattern is provided from the antenna array. Similarly, the first and second module 43 and 44 can be lowered by one row to provide a horizontal/vertical module configuration wherein the radiation pattern is horizontally/vertically polarized.

A vertically/vertically polarized radiation pattern can be also be obtained by lowering the first and second modules to the last two rows of the array 45 and 46 to the vertical/vertical module configuration shown in FIG. 4*b*.

Figure 5:
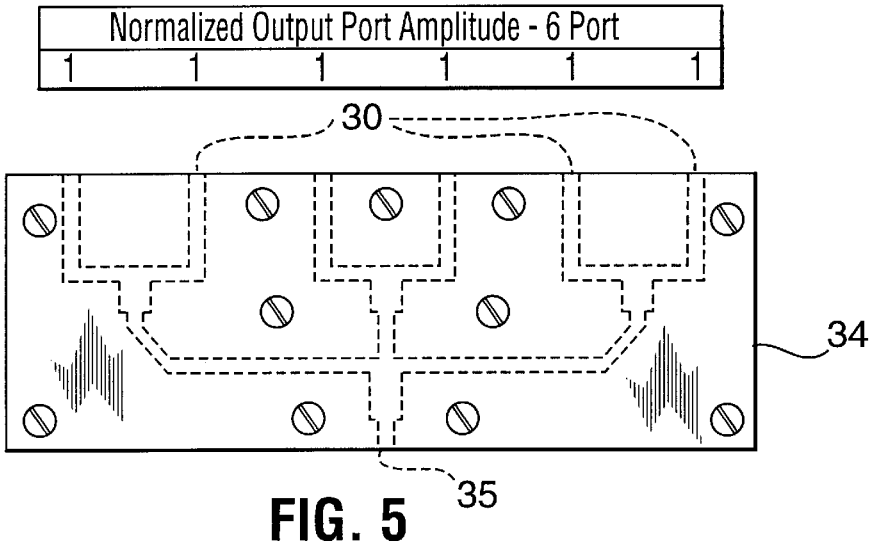
FIG. 5 is a diagram illustrating a power distribution module according to one embodiment of the invention.

Referring now to FIG. 5, we have shown the power distribution network of FIG. 3*b*. In particular, as indicated previously, the power distribution network 34 which when provided with a predetermined number of transmission lines forming a predetermined pattern can give a normalized signal at each output port. For example, given an input signal at input port 35, a normalized output amplitude is provided at the six (6) output ports 30. Thus, assuming we have an input signal of the order of 6 watts at input port 35, each output port 30 will produce a normalized output signal equal to ⅙ of the amplitude of the input signal, i.e. 1 watt.

Figure 6:
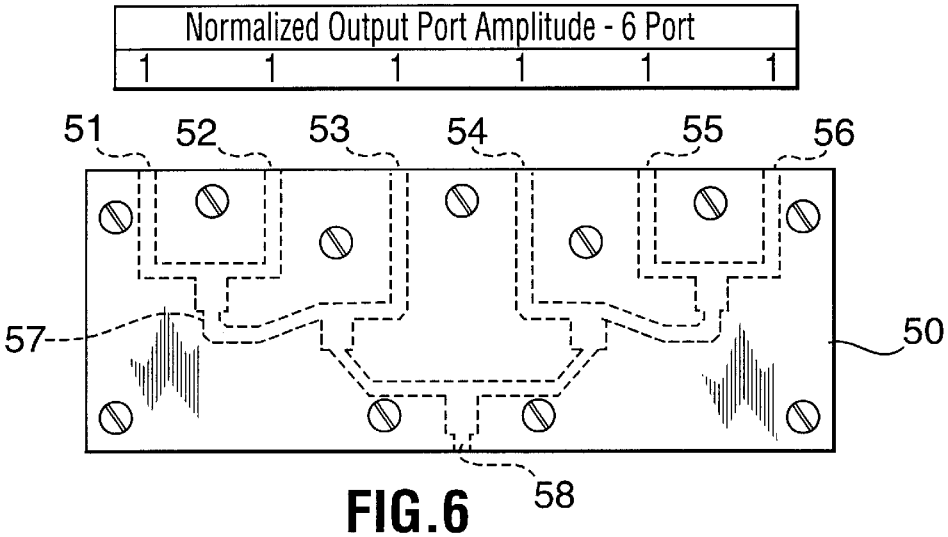
FIG. 6 is a diagram illustrating a power distribution module according to another embodiment of the invention.

Referring now to FIG. 6, we have shown another power distribution network 50 wherein the output amplitude at each output port is varied by introducing a different power distribution pattern. In this embodiment, the first two output ports 51 and 52 will provide an output which is half of the output of the third and fourth output ports 53 and 54 respectively. Similarly, the last two output ports 55 and 56 will also provide an output amplitude which is half of the third and fourth 53 and 54. Thus, the power distribution can be changed by making use of power dividers. Power dividers can be used to give a balanced or unbalanced power division. For example, in order to obtain a balanced power division network, an input signal is divided into two even amplitudes by splitting the output transmission line. On the other hand an unbalanced power division network is accomplished by dividing the distributing network such that one transmission line is split a second time for example, whereas the first one isn't. We can therefore achieve an unbalanced power division network. For example, as shown in FIG. 6, what would normally be the first output port 57 is split to two output ports 51 and 52, whereas output port 53 remains unchanged. Thus in the example given above, wherein an input signal of the order of 6 watts is provided at the input port 58, the resulting output power at each of the output ports will vary according to the power division provided by the power distribution network. In particular, in FIG. 6, output ports 51 and 52 will provide an output of ¾ of a watt, output ports 53 & 54 will provide an output power of 1.5 watts and output ports 55 and 56 will provide output power of ¾ of a watt each.

Figure 7:
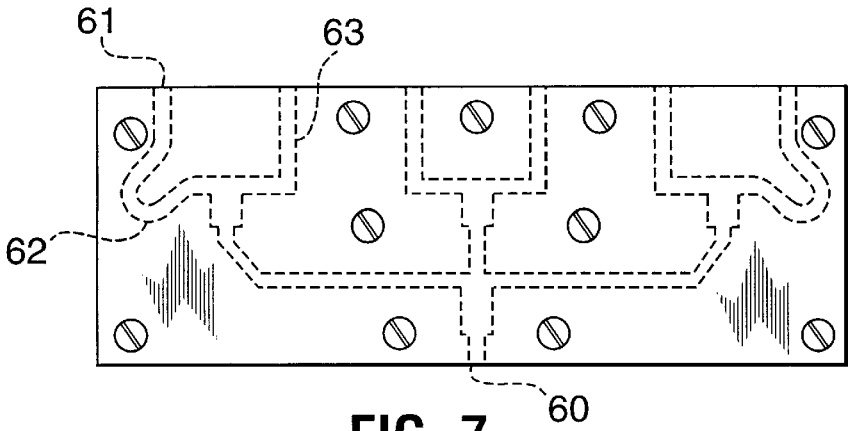
FIG. 7 is a diagram illustrating a power distribution module according to yet another embodiment of the invention.

Referring now to FIG. 7, we shown yet another power distribution network wherein a phase shift of an input signal is achieved at the output. A change in phase at an output port can be provided by varying the length of the transmission line which carries the signal. For example, a 180 degree phase change can be obtained by varying the length of the output transmission line by $\lambda/2$ wherein $\lambda$ is equal to c/f and c is the speed of light and f is the frequency of the input signal. Thus in the power distribution network of FIG. 7, a signal provided at the input port 60 having a predetermined phase will be modified at output port 61 by the introduction of a transmission line 62 which is of greater length than transmission line 63. Thus, even though the output signal of transmission lines 62 and 63 will have the same output amplitude, these signals will have different phase shifts.

Figure 8A:
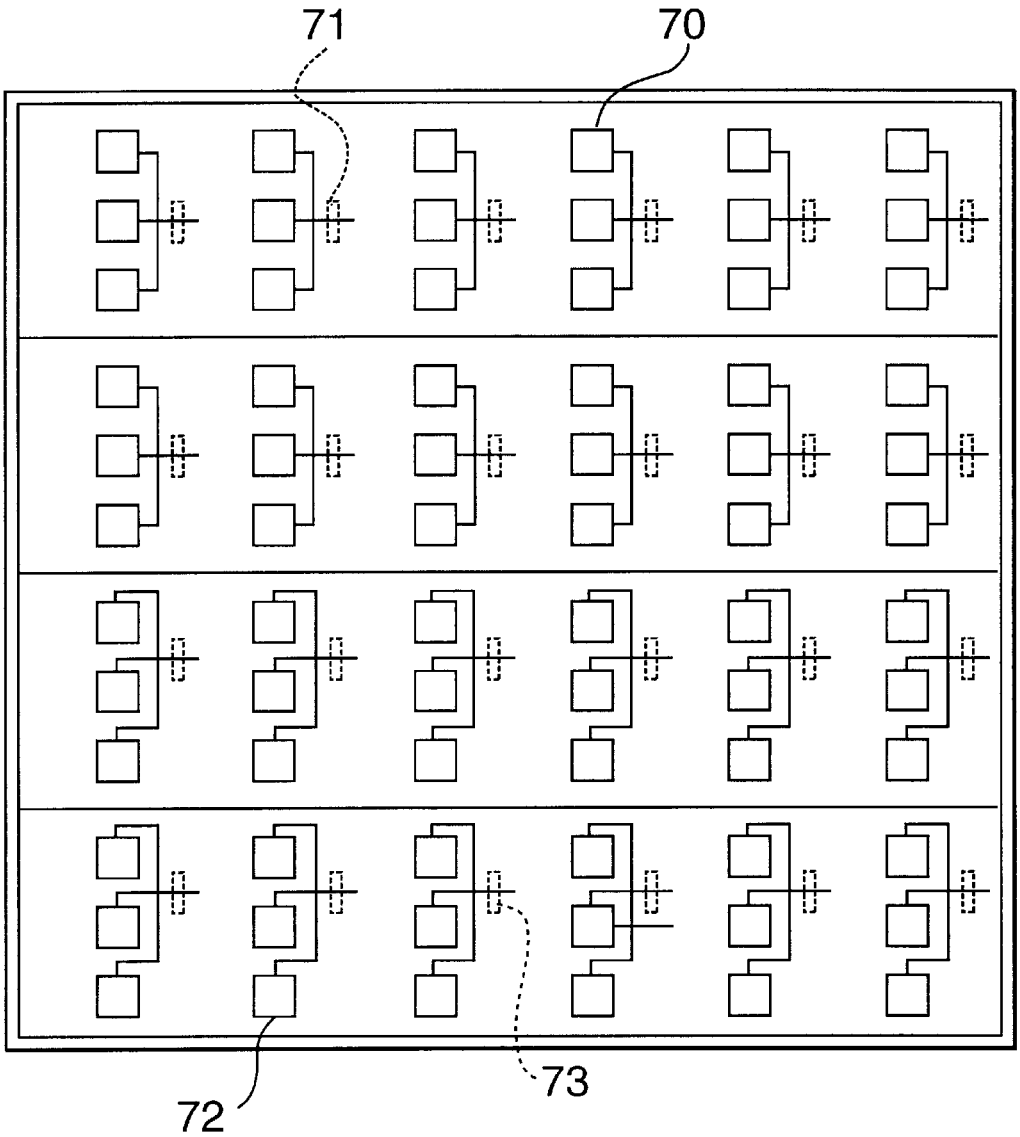
FIGS. 8*a*, 8*b* & 8*c* are front, side and rear views, respectively of a panel array antenna according to another embodiment of the invention.
Figure 8B:
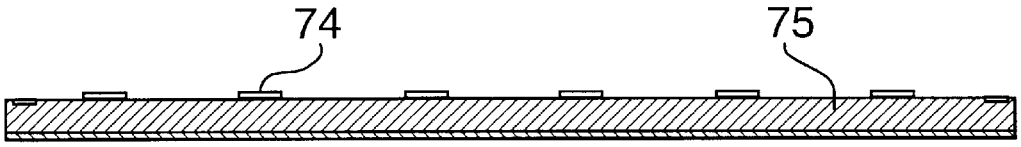
Figure 8C:
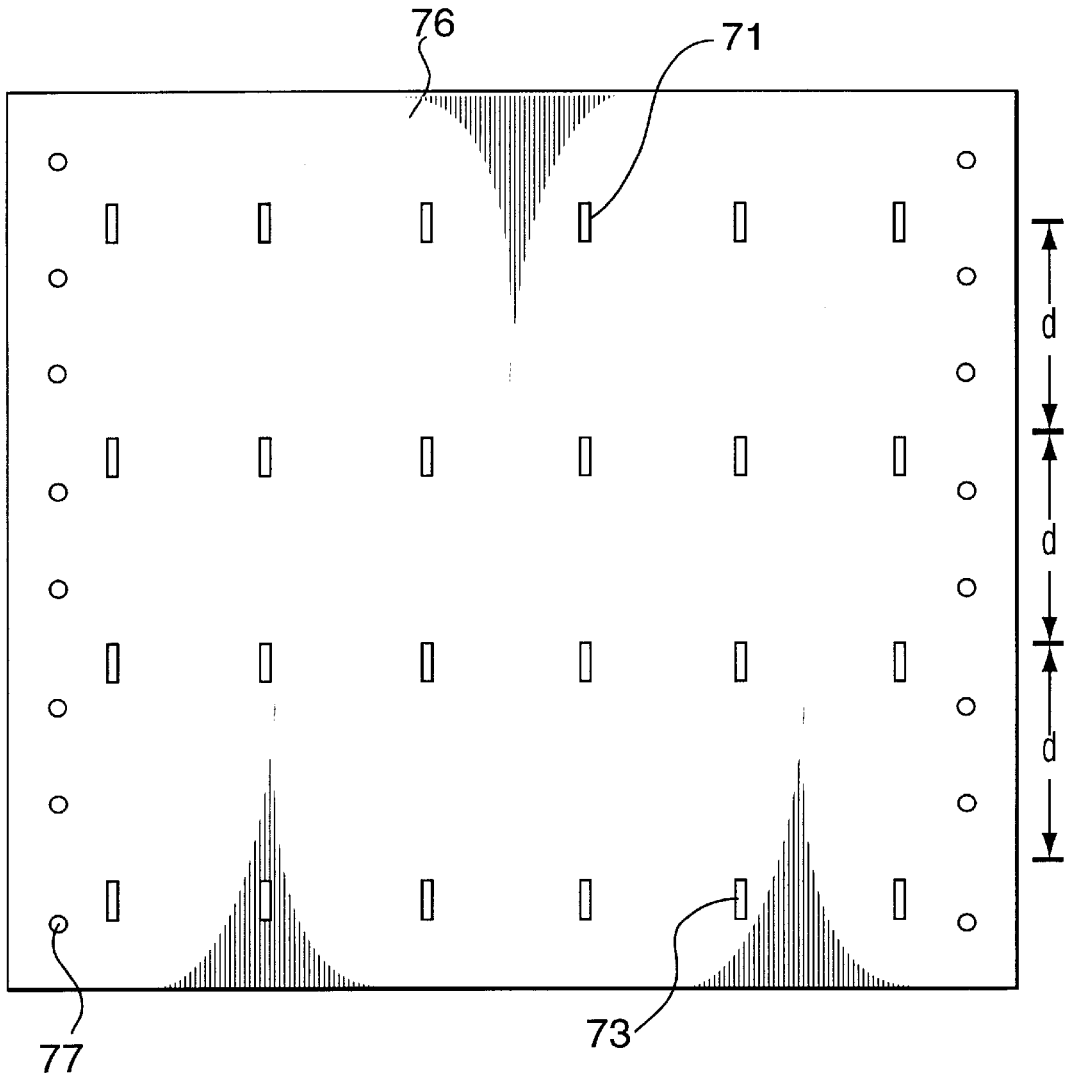

Referring now to FIG. 8*a*, we have shown a front view of an antenna element panel with a printed antenna array and horizontal and vertical polarized antenna elements. Horizontal polarization is provided by means of horizontal antenna array elements 70 and horizontal feed port which is shown in the form of an aperture-coupled slot 71. Similarly, vertical polarization is provided by means of vertical antenna array elements 72 and vertical feed ports, again in the form of an aperture-coupled slot 73. As shown in FIG. 8*b*, the printed antenna array is formed by placing the antenna elements 74 on a microstrip substrate 75. FIG. 8*c* is a rear view of the antenna element panel of FIG. 8*a*. The antenna element panel is shown with a ground plane 76 and horizontal and vertical feed ports 71 and 73 respectively. As discussed earlier, alignment dowel pins 77 are provided to enable the placement of the feed network modules.

In operation, the antenna elements are energized by a feed network which electromagnetically couples slots 71 and 73 in the ground plane 76. As illustrated in FIG. 8*a* and 8*c*, one side of the antenna panel consists of radiating elements and the other side contains the radiating elements feed ports. The placement of the feed network modules on the antenna panel will determine how the output radiation pattern is polarized.

Figure 9A:
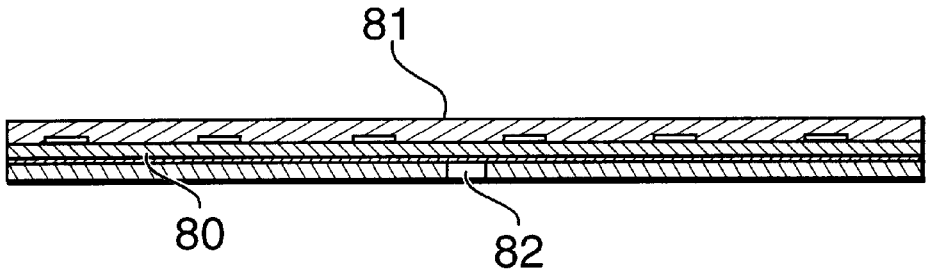
FIGS. 9*a* and 9*b* are front and side views, respectively of a power distribution network according to yet another embodiment of the invention.
Figure 9B:
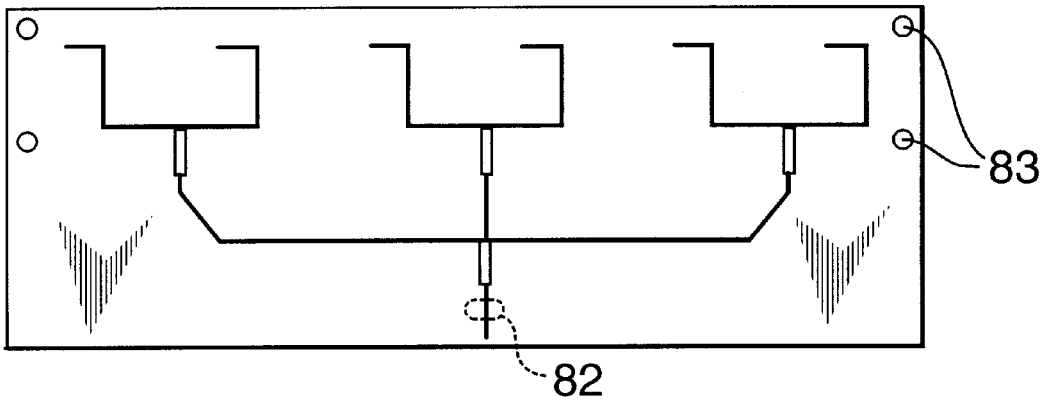

Referring now to FIG. 9*a*, we have shown a side view of a phase and power distribution module according to another embodiment of the invention. The module is a printed structure having a microstrip substrate 80, a radome cover 81 and input port 82. In the embodiment of FIG. 9*a* and 9*b*, the distribution module makes use of microstrip transmission lines. The module electro-magnetically couples to the antenna through slot coupling 82. The module is a power/phase distribution network. Microwave energy is input into the module and the appropriate amplitude/phase is distributed to the output ports. The dowel pin holes 83 interface with the dowel pins of the antenna panel.

As indicated previously, the advantages of using the modular antenna of the present invention is that one antenna can be used in many different applications by simply aligning the module to the antenna ports offering the required polarization pattern. Since only one antenna is required to be manufactured, there is considerable cost savings in simply exchanging a module without having to modify the array.

What is claimed is:

1. A modular antenna comprising:

an antenna panel having a number of antenna radiating elements forming an array, each antenna radiating element having a feed port; and a passive feed network module for detachably interfacing with said antenna panel, said feed network module having a number of output ports, each output port of said feed network module being adapted to detachably interface with a respective one of each feed port of said antenna radiating elements.

2. A modular antenna for providing changeable sector beamwidth capability, said modular antenna comprising:

a number of radiating elements disposed to form an antenna array;

a passive wave guide type feed network for detachably interfacing with said radiating elements, said wave guide type feed network module having a predetermined phase and power distribution; and wherein sector beamwidth capability of said modular antenna is selectively changeable by interchanging said wave guide type feed network module having said predetermined phase and power distribution with another wave guide type feed network module having a differing predetermined phase and power distribution.

3. A modular antenna as defined in claim 1, wherein said feed network module includes a predetermined phase and power distribution network such that phase and power distribution of a signal carried by said modular antenna is selectively changeable by interchanging said feed network module having said predetermined phase and power distribution with another feed network module having a differing predetermined phase and power distribution.

4. A power distribution module for coupling with an antenna panel comprising:

a passive feed network having an input port and one or more output ports, said input port being connected to said one or more output ports via a number of transmission lines which distribute an input signal from said input port to said one or more output ports such that the power and phase of said input signal is distributed to each of said one or more output ports according to a predetermined pattern; and wherein each said one or more output ports are capable of removable attachment to a respective input of said antenna panel.

5. A power distribution module as defined in claim 4, wherein a transmission line originating at said input port is equally divided to each of said one or more output ports to provide a balanced power division at each output port.

6. A power distribution module as defined in claim 4, wherein one output of said transmission line is further split in order to provide an unbalanced power division between said one or more output ports.

7. A power distribution module as defined in claim 4, wherein said transmission line comprises one or more microstrips.

8. A power distribution module as defined in claim 4, wherein said transmission line comprises one or more waveguides.

9. A power distribution module as defined in claim 5, wherein one or more of said transmission lines forming said distribution network is made of unequal length in order to provide a phase variance from one output port to another.

10. A power distribution module as defined in claim 6, wherein one or more of said transmission lines forming said distribution network is made of unequal length in order to provide a phase variance from one output port to another.

* * * * *